US010240851B2

(12) United States Patent
Kim et al.

(10) Patent No.: US 10,240,851 B2
(45) Date of Patent: Mar. 26, 2019

(54) REFRIGERATOR

(71) Applicant: HEFEI MIDEA REFRIGERATOR CO., LTD., Hefei, Anhui (CN)

(72) Inventors: Sang-uk Kim, Seoul (KR); Zhengguang Lv, Anhui (CN); Zhongcheng Fang, Anhui (CN)

(73) Assignee: HEFEI MIDEA REFRIGERATOR CO., LTD., Hefei, Anhui (CN)

( * ) Notice: Subject to any disclaimer, the term of this patent is extended or adjusted under 35 U.S.C. 154(b) by 0 days.

(21) Appl. No.: 15/222,932

(22) Filed: Jul. 28, 2016

(65) Prior Publication Data

US 2017/0248348 A1 Aug. 31, 2017

(30) Foreign Application Priority Data

Feb. 26, 2016 (KR) ..... 10-2016-0022986
Apr. 8, 2016 (KR) ..... 10-2016-0043245
Apr. 12, 2016 (KR) ..... 10-2016-0045178

(51) Int. Cl.
*F25B 5/02* (2006.01)
*F25B 49/02* (2006.01)
(Continued)

(52) U.S. Cl.
CPC ..... *F25D 17/08* (2013.01); *F25B 5/02* (2013.01); *F25B 41/067* (2013.01); *F25B 49/02* (2013.01); *F25D 11/022* (2013.01); *F25D 17/065* (2013.01); *F25C 2400/10* (2013.01); *F25D 2317/061* (2013.01); *F25D 2317/062* (2013.01); *F25D 2317/067* (2013.01); *F25D 2317/0667* (2013.01)

(58) Field of Classification Search
CPC ..... F25B 41/067; F25B 49/02; F25B 5/02; F25D 11/022; F25D 17/065; F25D 2317/061; F25D 2317/062; F25D 2317/0667; F25D 2317/067; F25C 2400/10
USPC ..... 62/340, 441
See application file for complete search history.

(56) References Cited

U.S. PATENT DOCUMENTS 2,962,951 A * 12/1960 Holmes ..... B60H 1/00257 237/28
4,462,303 A * 7/1984 Gebhard ..... B60H 1/248 454/134

(Continued)

FOREIGN PATENT DOCUMENTS

KR 20130035401 A 4/2013

OTHER PUBLICATIONS

European Patent Office, Office action issued for EP application 16181376, which is an European counterpart application of the present US patent application.

*Primary Examiner* — Christopher R Zerphey
(74) *Attorney, Agent, or Firm* — Houtteman Law LLC

(57) ABSTRACT

A bottom-freezer refrigerator has an ice making compartment formed in a door thereof. Cold air formed in independent spaces of the refrigerating compartment is individually guided to the ice making compartment and the refrigerating compartment, thereby reducing power consumption and noise to be caused as the length of a fluid passage is increased. Foods are refrigerated or frozen and stored in a clean state. The foods in the refrigerating compartment are freshly stored in a high moisture state, and the door is prevented from being forcibly open.

6 Claims, 16 Drawing Sheets

(51) Int. Cl.

| | |
|---|---|
| ***F25D 11/02*** | (2006.01) |
| ***F25B 41/06*** | (2006.01) |
| ***F25D 17/08*** | (2006.01) |
| ***F25D 17/06*** | (2006.01) |

(56) References Cited

U.S. PATENT DOCUMENTS

| | | | | | |
|---|---|---|---|---|---|
| 4,478,052 | A * | 10/1984 | McDowell | B60H 1/247 | 62/244 |
| 5,548,969 | A * | 8/1996 | Lee | F25B 49/025 | 62/131 |
| 6,662,504 | B2 * | 12/2003 | Krogstad | E04B 1/7046 | 52/61 |
| 6,732,543 | B2 * | 5/2004 | Jenkins, Jr. | F25D 17/08 | 62/298 |
| 9,625,202 | B2 * | 4/2017 | Lopes | F25D 17/065 | |
| 2008/0148761 | A1 * | 6/2008 | Venkatakrishnan | F25D 17/065 | 62/340 |
| 2010/0251743 | A1 * | 10/2010 | Lee | F25D 17/065 | 62/340 |
| 2011/0146331 | A1 * | 6/2011 | Moon | F25C 1/04 | 62/407 |
| 2011/0185760 | A1 * | 8/2011 | Suh | F25B 5/00 | 62/344 |
| 2011/0302938 | A1 * | 12/2011 | Lee | F25D 17/065 | 62/89 |
| 2012/0000238 | A1 * | 1/2012 | Tikhonov | F25D 17/045 | 62/344 |
| 2012/0085120 | A1 * | 4/2012 | Davis | F16J 15/064 | 62/340 |
| 2012/0291469 | A1 * | 11/2012 | Li | F25D 29/00 | 62/186 |

* cited by examiner

REFRIGERATOR

CROSS-REFERENCE TO RELATED APPLICATION(S)

This application claims the benefit under 35 U.S.C. § 119(a) of a Korean patent application filed on Feb. 25, 2016 in the Korean Intellectual Property Office and assigned Serial number 10-2016-0022986, of a Korean patent application filed on Apr. 8, 2016 in the Korean Intellectual Property Office and assigned Serial number 10-2016-0043245, of a Korean patent application filed on Apr. 12, 2016 in the Korean Intellectual Property Office and assigned Serial number 10-2016-0045178, the entire disclosure of each of which is hereby incorporated by reference.

BACKGROUND OF THE INVENTION

1. Field of the Invention

The present invention relates to a bottom-freezer refrigerator having an ice making compartment formed in a door, and more particularly to a refrigerator capable of minimizing power consumption and noise, being maintained in a clean state, maintaining a refrigerating compartment in a high-moisture state, and preventing an opposite door from being forcibly open when one door is open.

2. Description of the Related Art

In general, a refrigerator is a device aiming at storing foods at a low temperature. In addition, the refrigerator is an electronic appliance to freeze or refrigerate foods to be stored according to the states of the foods. Recently, refrigerators have been developed in various forms in order to improve the standard of living and satisfy various preferences of a consumer.

In other words, there is introduced a bottom-freezer refrigerator in which an internal space having a polygonal shape is formed in a body, a partition is installed to divide the internal space into upper and lower spaces, a refrigerating compartment is formed in the upper space, a freezing compartment is formed in a lower space, and a plurality of doors are rotatably coupled to the front surface of the refrigerator, so that a user can easily draw foods out of the refrigerating compartment without bending the waist of the user for the use of the foods.

According to embodiments, there is introduced a refrigerator having ice making facilities installed in the door of the refrigerating compartment.

However, according to the refrigerator, an evaporator of the freezing compartment in the lower space generates cold air through a heat-exchange scheme, the cold air is moved to an inner part of an ice making compartment through a fluid passage. In this case, the cold air of the ice making compartment is moved into the refrigerating compartment to store articles in the refrigerating compartment at a low temperature. Then, the cold air of the refrigerating compartment is moved into the freezing compartment to form a circulation structure of the ice making compartment, the refrigerating compartment, and the freezing compartment.

Therefore, as the conventional bottom-freezer refrigerator has a long fluid passage to link the freezing compartment, the ice making compartment, and the refrigerating compartment with each other, it is difficult to adjust the cooling speed.

In particular, as the length of the fluid passage, through which the cold air is moved, is increased, power consumption is increased due to the operation of a motor and heat loss to keep cold air, and noise is increased.

In addition, according to the conventional refrigerator, the refrigerating compartment positioned in the upper space must have sufficient moisture to maintain foods in a fresh state. To the contrary, the freezing compartment must be maintained in a dry state because, if the freezing compartment has a large amount of moisture, frost may be made.

However, according to the conventional refrigerator, the moisture of the refrigerating compartment is moved into the freezing compartment, so that the frost is made inside the freezing compartment. On the contrary, the dried freezing compartment circulates the cold air to insufficiently reduce the moisture of the refrigerating compartment, so that the freshness of the foods is degraded.

Furthermore, according to the bottom-freezer refrigerator, the cold air circulates between the refrigerating and freezing compartments having mutually different doors.

If the door of the refrigerating compartment is strongly closed, the air is introduced into the refrigerating compartment. In this case, the introduced air is moved into the freezing compartment through the refrigerating compartment, so that the freezing compartment is fully filled with the introduced air to forcibly open the door of the freezing compartment.

In addition, the cold air is moved into the space between the refrigerating compartment, the ice making compartment, and the freezing compartment, so that the smell of foods received in the refrigerating compartment or the freezing compartment may be spread throughout the whole refrigerator.

As cited references of related arts, there are KR10-2005-0127516 A1 (cited reference 1) and KR10-2005-0008905 A1 (cited reference 2).

SUMMARY OF THE INVENTION

The present invention is made to solve the problem occurring when a fluid passage through cold air created inside a freezing compartment by an evaporator repeatedly circulates between an ice making compartment and a refrigerating compartment is maintained with a long length. In other words, the present invention is to minimize power consumption and noise while maintaining the fluid passage of the cold air moving among the freezing compartment, the ice making compartment, and the refrigerating compartment, to maintain the refrigerating compartment in a sufficiently high moisture state while maintaining the freezing compartment in a dry state, thereby preventing frost, to prevent the smell of foods from being spread throughout the whole refrigerator so that the refrigerator is maintained in a clean state, and to prevent one door from being forcibly open when an opposite door is closed.

In order to accomplish the above object, according to the present invention, there is provided a refrigerator including a body formed at a lower portion thereof with a freezing compartment and formed at an upper portion thereof with a refrigerating compartment, first and second cold air forming parts formed in the refrigerating compartment, first and second evaporators installed in the first and second cold air forming parts, respectively, a plurality of doors rotatably installed in the refrigerating compartment and the freezing compartment, respectively;

an ice making compartment formed in the door installed in the refrigerating compartment, a cold air inlet/outlet duct having one side connected with the second cold air forming part and an opposite end portion exposed inside an inner wall or to a front surface of the refrigerating compartment, and a connection member installed with a predetermined thickness at one side of the ice making compartment of the door to make close contact with the opposite end portion of the cold air inlet/outlet duct while communicating with the cold air inlet/outlet duct.

Cold air, which is formed inside the second cold air forming part through a heat exchange scheme when the second evaporator of the refrigerating compartment is operated, is guided to the ice making compartment of the door through the cold air inlet/outlet duct and the connection member.

In addition, according to the embodiment of the present invention, there is provided a refrigerator including a body formed at a lower portion thereof with a freezing compartment and formed at an upper portion thereof with a refrigerating compartment, first and second cold air forming parts formed in the refrigerating compartment, first and second evaporators installed in the first and second cold air forming parts, respectively, a plurality of doors rotatably installed in the refrigerating compartment and the freezing compartment, respectively, an ice making compartment formed in the door installed in the refrigerating compartment, a cold air inlet/outlet duct having one side connected with the second cold air forming part and an opposite end portion exposed inside an inner wall of the refrigerating compartment, and a connection pipe which is installed between the ice making compartment and the cold air inlet/outlet duct and expanded or contracted according to open/close states of the door.

Cold air formed by the second cold forming part of the refrigerating compartment is guided to the ice making compartment of the door through the cold air inlet/outlet duct and the connection pipe such that ices having uniform quality are produced regardless of the open/close states of the door.

In addition, according to the embodiment of the present invention, there is provided a refrigerator including a body formed at a lower portion thereof with a freezing compartment and formed at an upper portion thereof with a refrigerating compartment, a first cold air forming part formed in the refrigerating compartment to supply cold air to the refrigerating compartment, a first evaporator installed in the first cold air forming part, and a compressor, a condenser, and an expander, which are installed in the body to compress and condense a coolant, and reduce pressure of the coolant, a plurality of doors rotatably installed in the refrigerating compartment and the freezing compartment, respectively, an ice making compartment formed in the door installed in the refrigerating compartment, a second cold air forming part formed in the door to guide the cold air to the ice making compartment, a second evaporator installed in the second cold air forming part, a flexible capillary tube interposed between the door and the body, and having one side connected with a first connection pipe of the second evaporator and an opposite side connected with a pipe of a condenser, and a suction tube interposed between the door and the body, and having one side connected with a second connection pipe of a second evaporator and an opposite side connected with the pipe of the condenser.

As described above, according to the present invention, the cold air formed in each independent space is supplied to the ice making compartment, the refrigerating compartment, and the freezing compartment.

Accordingly, the length of the fluid passage for moving the cold air is reduced, so that the power consumption and the noise can be reduced.

In addition, the refrigerating compartment is maintained in the sufficiently high moisture state to freshly store foods in a cooling state, and the freezing compartment is maintained in the dry state to minimize the frost.

In addition, the problem caused by the smell movement of the foods can be solved, and the foreign matters are prevented from being introduced into the ice making compartment. Accordingly, the refrigerating compartment, the freezing compartment, and the ice making compartment can be maintained in a clean state.

When the door of the refrigerating compartment is closed, the door of the freezing compartment can be prevented from being forcibly open.

DETAILED DESCRIPTION OF THE INVENTION

Hereinafter, embodiments of the present invention will be described in detail with reference to accompanying drawings.

Figure 1:
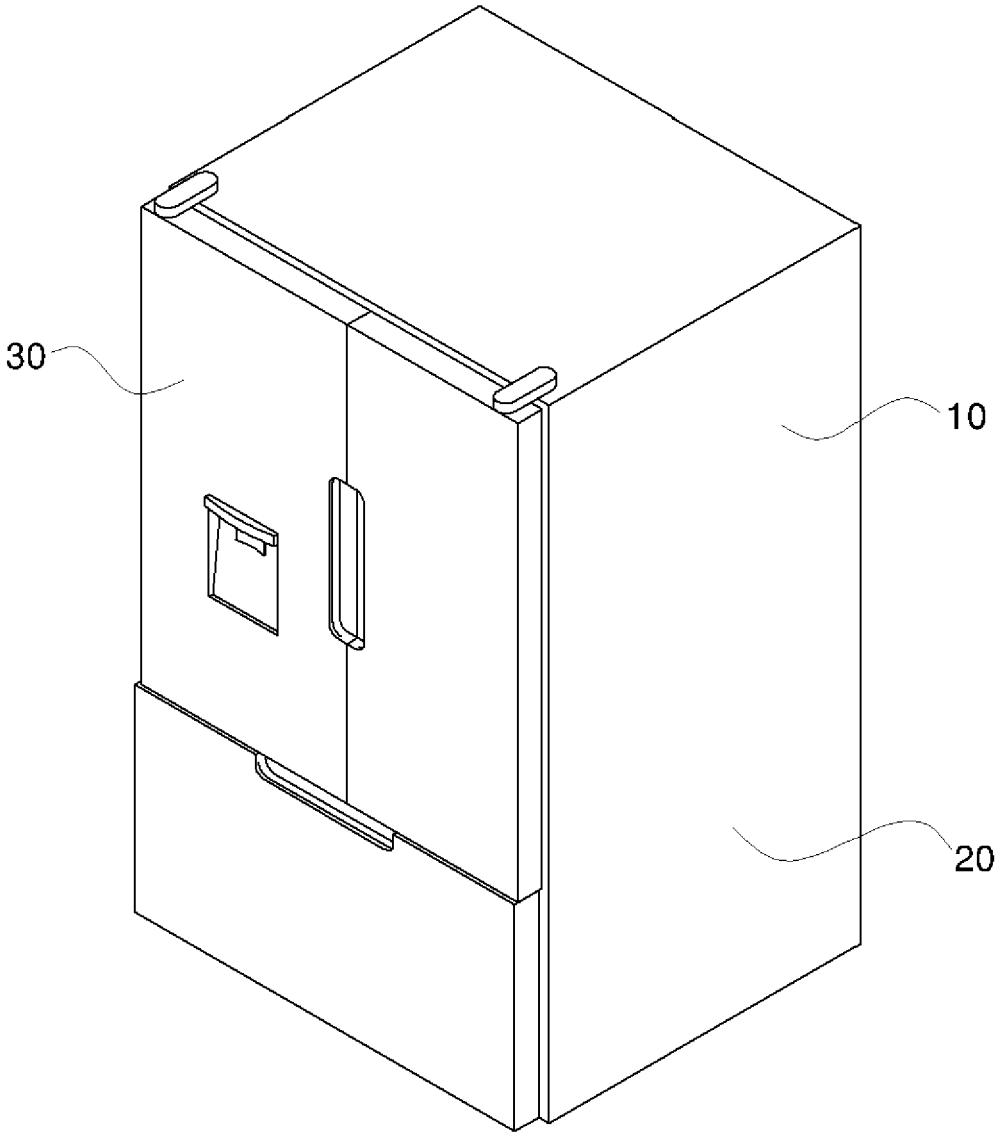
FIG. 1 is a perspective view showing a refrigerator according to the embodiment of the present invention.
Figure 2:
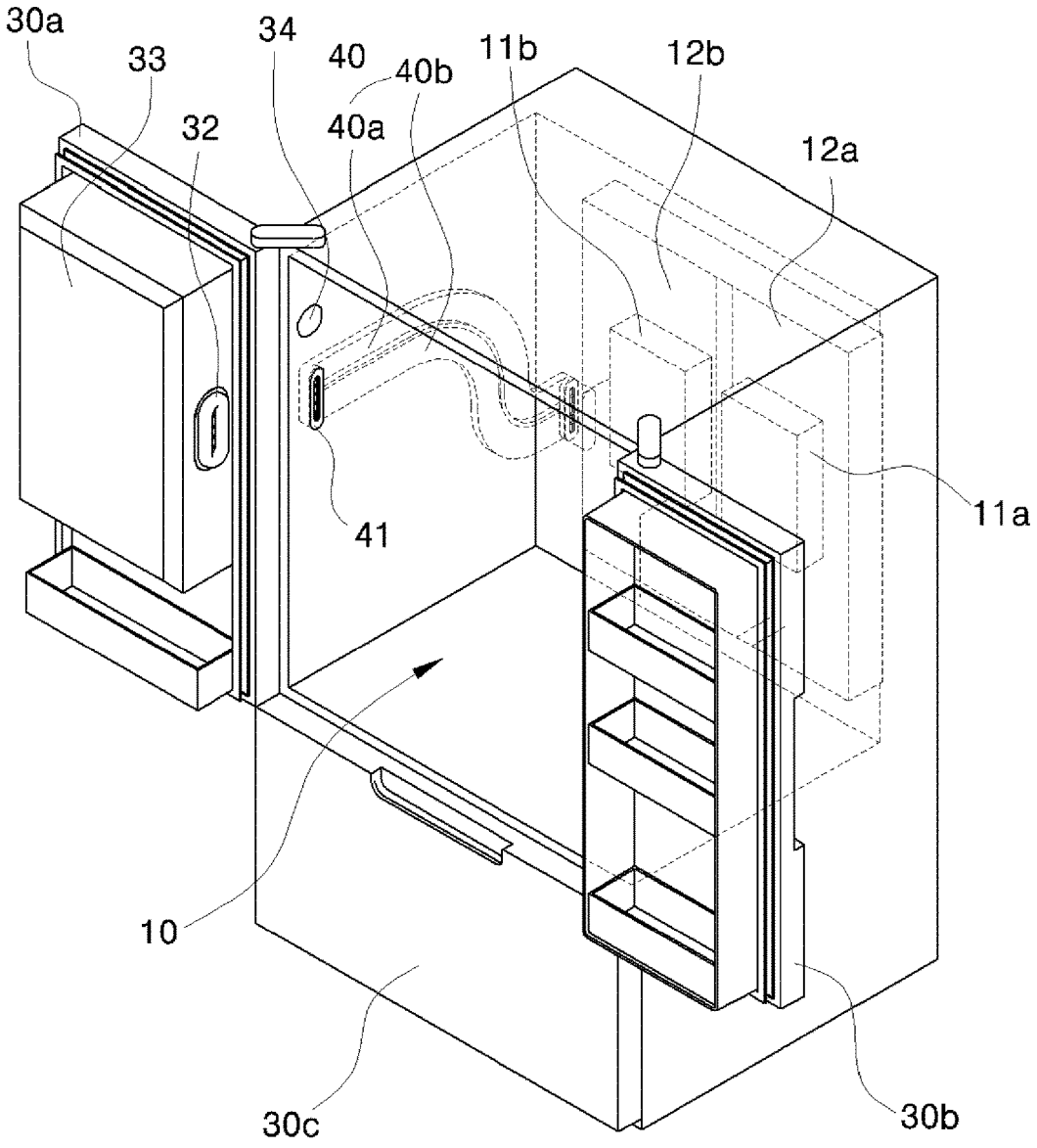
FIGS. 2 and 2A are perspective views showing a refrigerator according to the embodiment of the present invention.
Figure 2A:
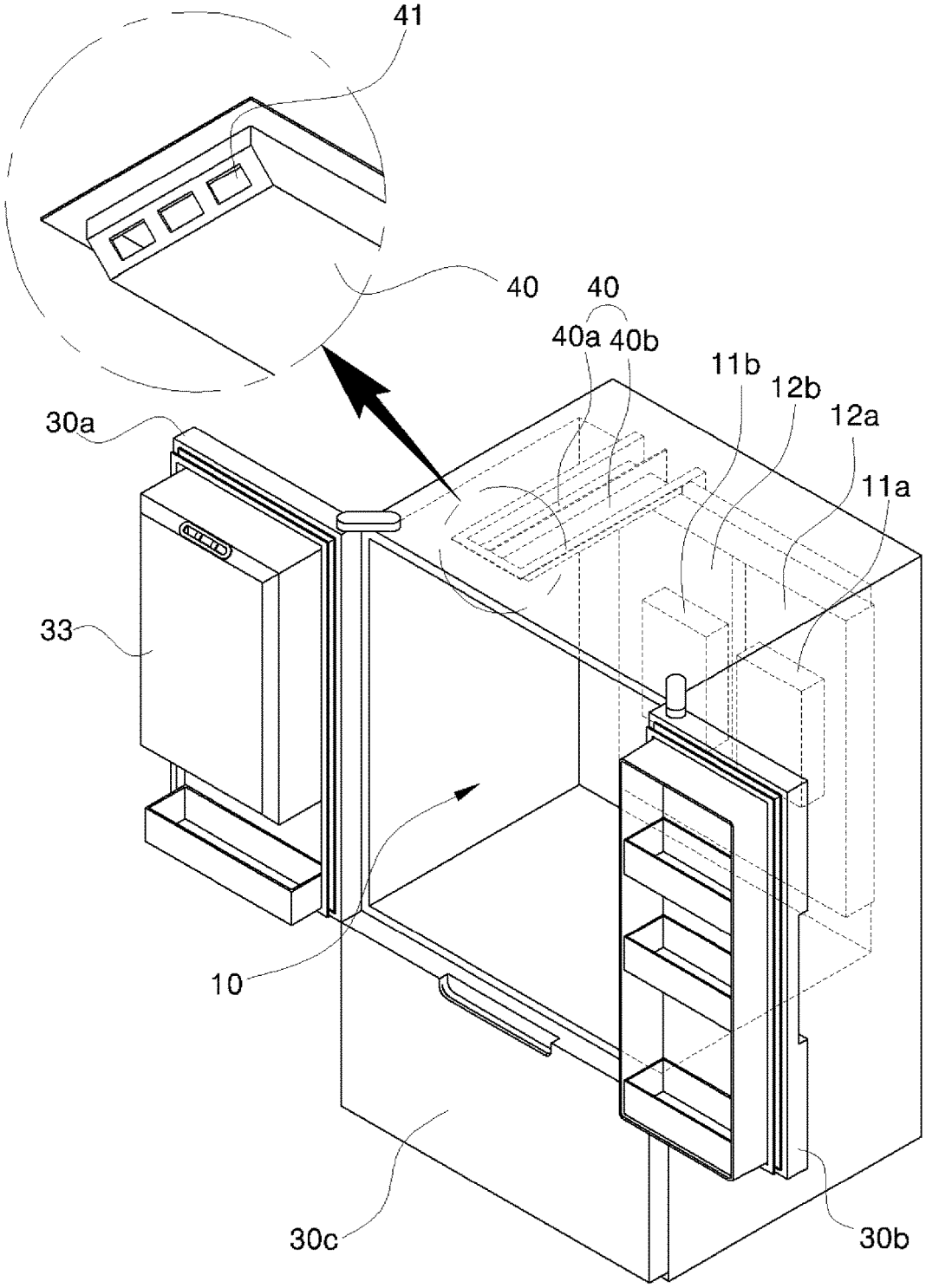

FIGS. 1 and 2 show appearances of a refrigerator when doors of the refrigerator are open and closed according to the embodiment of the present invention.

As shown in FIGS. 1 and 2, according to the present invention, an internal space is formed inside a body 1 having a polygonal shape, and a partition is formed in the internal space to divide a space into upper and lower portions, so that a refrigerating compartment 10 and a freezing compartment 20 are formed at one side and an opposite side of the internal space.

In this case, the refrigerating compartment 10 is formed at the upper portion of the body 1.

The refrigerating compartment 10 is provided therein with shelves to efficiently receive various kinds of foods to divide the space of the refrigerating compartment 10.

The heights of the shelves can be adjusted, and the shelves are detachably attached to the refrigerating compartment 10.

In addition, the refrigerating compartment 10 is provided at a rear portion thereof with an evaporator 11.

The refrigerating compartment 10 is provided at the inside thereof with a cold air forming part 12.

The cold air forming part 12 is configured to form the cold air at the inside thereof through a heat exchange scheme when the evaporator 11 is operated.

In this case, the cold air forming part 12 is divided into a first cold air forming part 12*a* and a second cold air forming part 12*b*.

A first evaporator 11*a* and a second evaporator 11*b* are installed in the first cold air forming part 12*a* and the second cold air forming part 12*b*, respectively.

In this case, the second cold air forming part 12*b* may be formed in a special compartment interposed between the refrigerating compartment 10 and the freezing compartment 20.

Further, the refrigerating compartment 10 is formed in a wall surface thereof with a cold air inlet/outlet duct 40 extending in a front-rear direction.

One side of the cold air inlet/outlet duct 40 is connected with the second cold air forming part 12*b*, and an opposite side of the cold air inlet/outlet duct 40 having a through hole formed therein is provided and exposed inside the refrigerating compartment 10 or in the front wall surface of the refrigerating compartment 10.

Further, an inlet/outlet port 31 is formed in the door 30.

The connection member 32 having a predetermined thickness is installed around the inlet/outlet portion 31.

Accordingly, when the door 30 is closed, the opposite end portion 41 of the cold air inlet/outlet duct 40 communicates with the inlet/outlet portion 31, so that the cold air is introduced to or withdrawn out of the inner part of the ice making compartment.

Further, a temperature sensor 34 is installed around the inlet/outlet portion 31.

When the open state of the door 30 is detected by the temperature sensor 34, it is recognized that the opposite end portion 41 of the cold air inlet/outlet duct 40 is spaced apart from the inlet/outlet portion 31.

Accordingly, a motor or a second damper 19 is automatically controlled, so that the movement of the cold air can be controlled.

In addition, the cold air inlet/outlet duct 40 is installed while protruding inside the refrigerating compartment 10. Alternatively, the cold air inlet/outlet duct 40 is installed in such a manner that only the opposite end portion of the cold air inlet/outlet duct is exposed inside of the wall surface of the refrigerating compartment 10.

In this case, the cold air inlet/outlet duct 40 may form a partition extending in a longitudinal direction inside one enclosure, so that the cold air is introduced into one side of the cold air inlet/outlet duct 40, and withdrawn out of an opposite side of the cold air inlet/outlet duct 40.

The cold air inlet/outlet duct 40 includes a cold air inlet duct 40*a*, which transfers the cold air to the ice making compartment from the second cold air forming part 12*b*, and a cold air outlet duct 40*b* which transfers the cold air to the second cold air forming part 12*b* of the refrigerating compartment 10 from the ice making compartment.

In addition, a cold air inlet port and a cold air outlet port may be formed in a lateral side or a rear surface of the door 30 corresponding to the cold air inlet/outlet duct 40.

In this case, the cold air inlet/outlet duct 40, or the cold air inlet/outlet duct 40 and the cold air outlet duct 40*b* are installed with the shortest path, if possible, between the ice making compartment 33 and the cold air forming part 12 in order to minimize the length of a fluid passage through which the cold air flows.

For reference, a plurality of doors 30*a* and 30*b* are rotatably installed on the front surface and the left/right lateral sides of the refrigerating compartment 10 to entirely or partially cover or open the open front surface of the refrigerating compartment 10.

In addition, the freezing compartment 20 is formed under the refrigerating compartment 10, and shelves are formed inside the freezing compartment 20 to efficiently receive foods to be frozen and stored.

A door 30*c* of the freezing compartment 20 is rotatably installed at the front surface of the freezing compartment 20 to cover an open internal space.

In addition, a third evaporator 21 is installed at a rear portion of the freezing compartment 20.

The third evaporator 21 is configured to form cold air in the third cold air forming part 22 inside the freezing compartment 20 through a heat exchange scheme, and to introduce the cold air into the freezing compartment 20 so that the foods are frozen and stored.

Therefore, according to the present invention, the freezing compartment 20 has a third evaporator 21, and the refrigerating compartment 10 has first and second evaporators 11*a* and 11*b*.

The cold air formed in each individual space is supplied to the ice making compartment 33, the freezing compartment 20, and the refrigerating compartment 10.

Accordingly, a refrigerating space is sufficiently ensured to solve the problem of increasing power consumption and noise, the problem caused by the smell movement of foods, and the problem of forcibly opening the door.

In addition, the inner part of the refrigerating compartment 10 is maintained in a high-moisture state to freshly store foods, and the freezing compartment 20 is maintained in a dry state to prevent frost from being formed.

Figure 3:
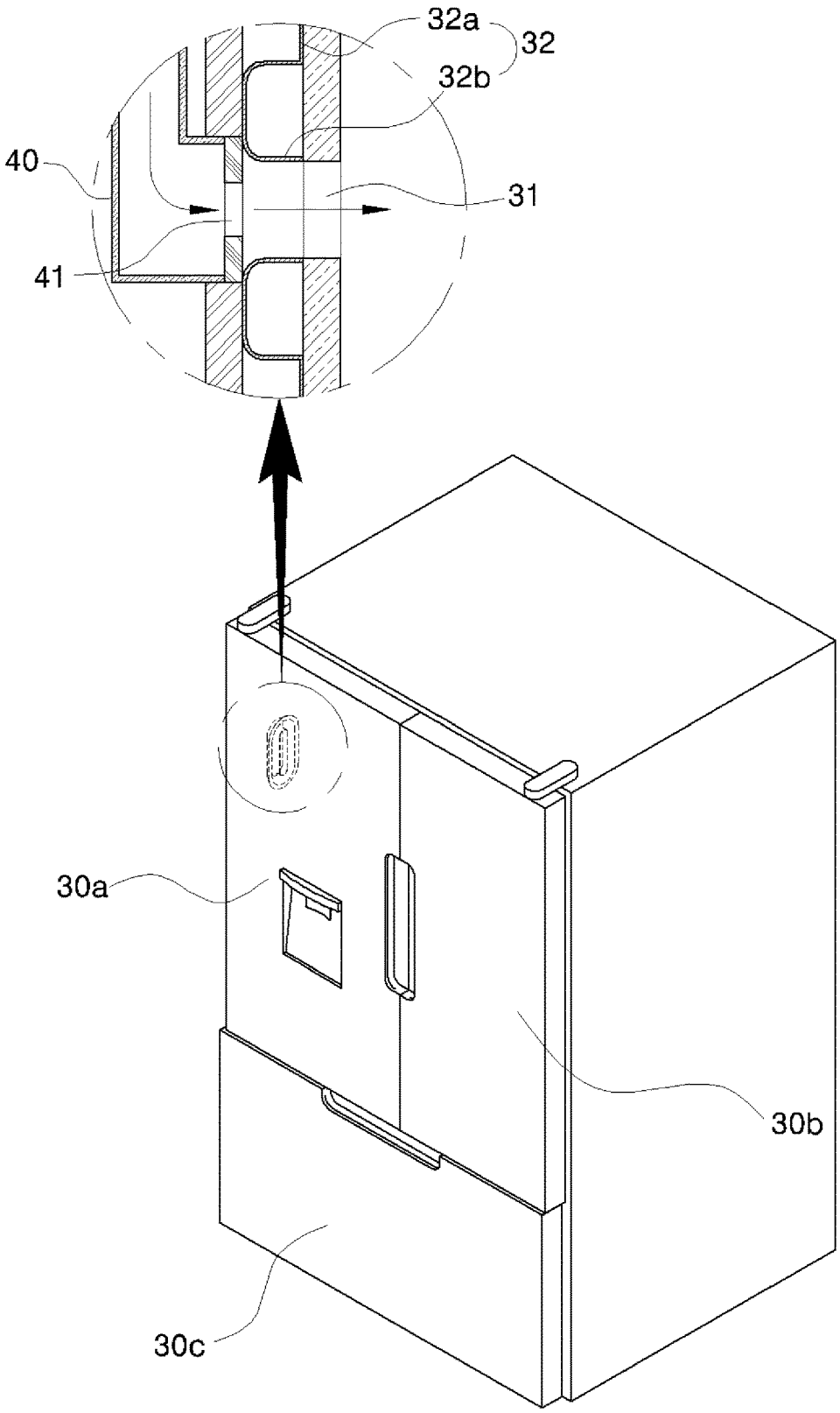
FIGS. 3 and 3A are a perspective view and an enlarged view showing a connection member of the refrigerator according to the embodiment of the present invention.
Figure 3A:
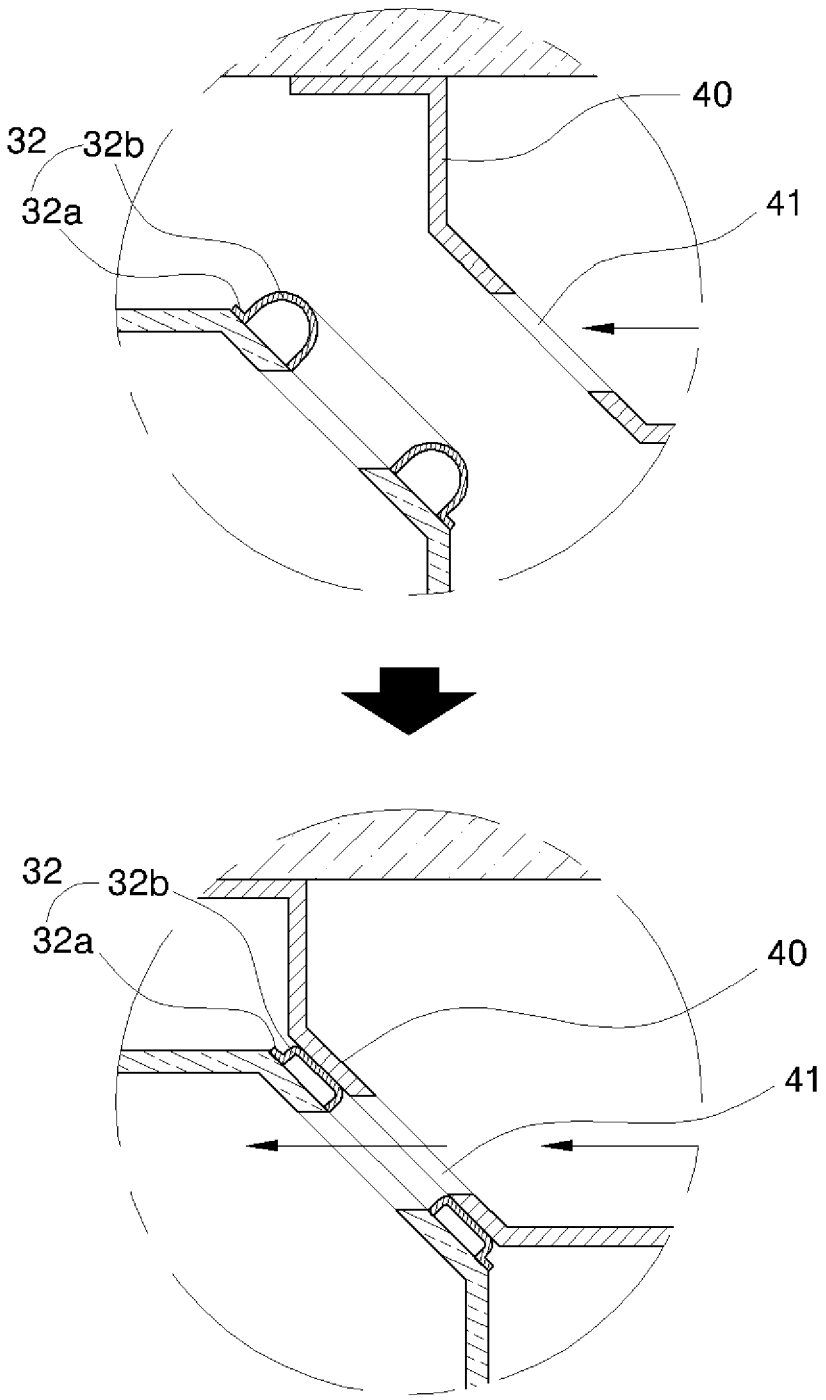
Figure 4:
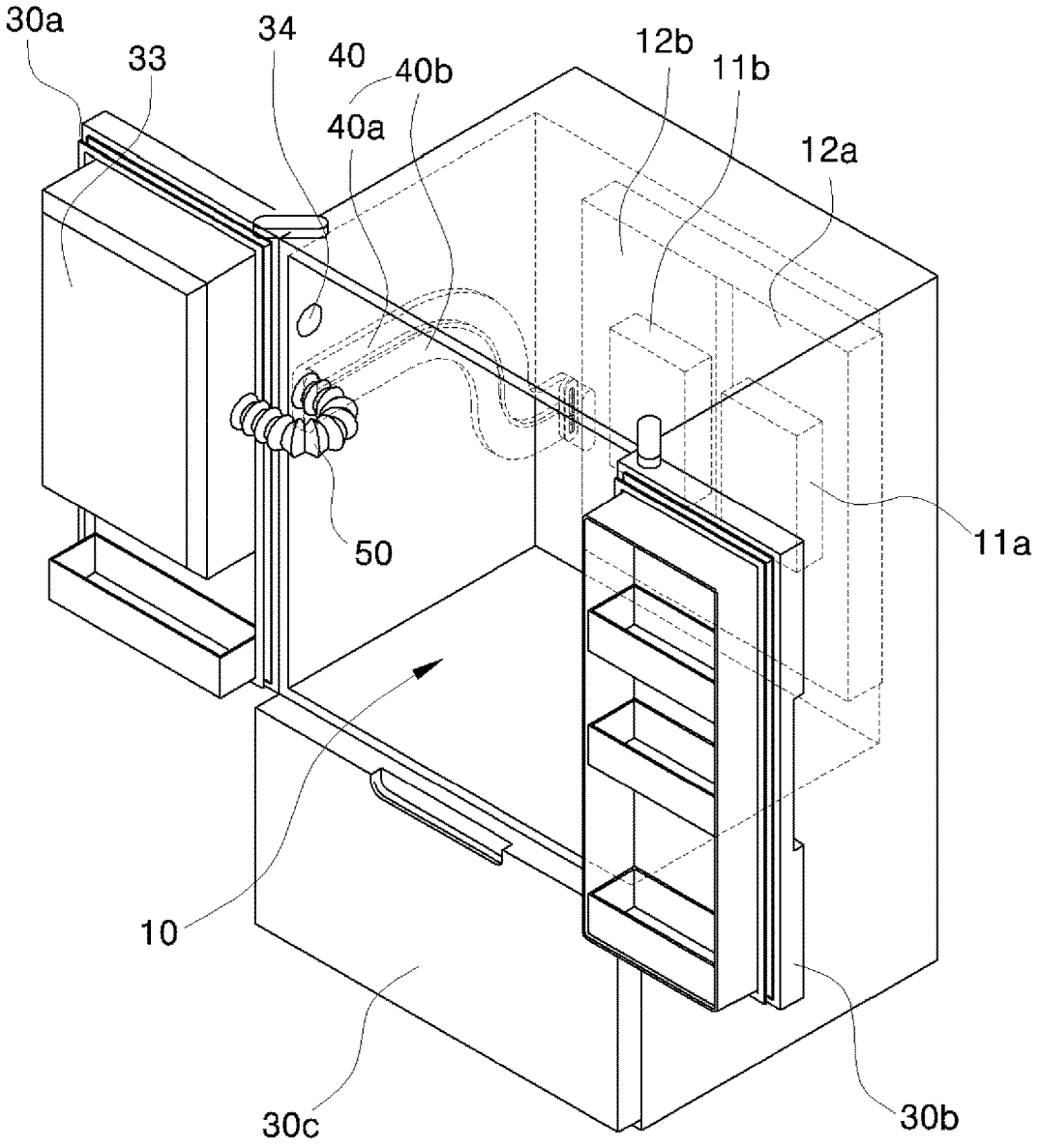
FIG. 4 is a perspective view showing a refrigerator according to the second embodiment of the present invention.

FIGS. 3 and 3A are a perspective view and an enlarged view showing the connection member operating according to the open/close state of the door.

Referring to FIGS. 3 and 3A, the connection member 32 is formed in the inlet/outlet port 31 of the door 30.

The connection member 32 includes a mounting part 32*a* having an annular shape and fixedly installed on the rim of an inlet/outlet port, or the rims of the inlet and outlet ports of the door, and an elastic member 32*b* protruding upward from the mounting part 32*a*, having a curved shape, and formed of a soft material.

The elastic member 32*b* has a predetermined thickness and is expanded and contracted.

When the door is closed, the elastic member 32*b* makes close contact with the opposite end portion 41 of a cold air inlet/outlet duct 40 to be contracted.

Accordingly, the space between the door and the refrigerating compartment 10 is filled with the elastic member 32*b*, so that the door and the refrigerating compartment 10 is a fully close contact state.

In addition, FIGS. 4 and 5A to 5C are a perspective view and a sectional view showing a refrigerator according to the second embodiment of the present invention.

Referring to FIGS. 4 and 5A to 5C, according to the present invention, the refrigerator includes a body 1 formed at a lower portion thereof with a freezing compartment 20 and formed at an upper portion thereof with a refrigerating compartment 10.

In the refrigerating compartment 10, a first cold forming part 12*a* and a second cold forming part 12*b* are formed.

First and second evaporators 11*a* and 11*b* are installed in the first cold forming part 12*a* and the second cold forming part 12*b*, respectively.

An ice making compartment 33 is formed in a door 30 of the refrigerating compartment 10.

In the refrigerating compartment 10, a cold air inlet/outlet duct 40 is formed having one side connected with a second cold air forming part 12*b* and an opposite end portion 41 exposed inside the refrigerating compartment 10 or in the front wall surface of the refrigerating compartment 10.

A connection pipe 50 is interposed between the ice making compartment 33 of the door 30 and the cold air inlet/outlet duct 40 to extend according to the open/close state of the door 30.

Accordingly, the cold air formed through the second evaporator 12*b* of the refrigerating compartment 10 is guided to the ice making compartment of the door through the cold air inlet/outlet duct 40 and the connection pipe 50 regardless of the open/close state of the door 30.

In this case, the connection pipe 50 is a flexible furrow pipe. When the door is open, the furrow part, which has been folded, is unfolded, so that the furrow part may be extended.

To the contrary, when the door is closed, the unfolded furrow part is folded, so that the furrow part is contracted. Accordingly, the cold air formed by the second cold forming part 12*b* is always supplied to the ice making compartment as the length of the connection pipe 50 is changed, so that ices having uniform quality can be acquired regardless of the open/close state of the door.

Figure 5A:
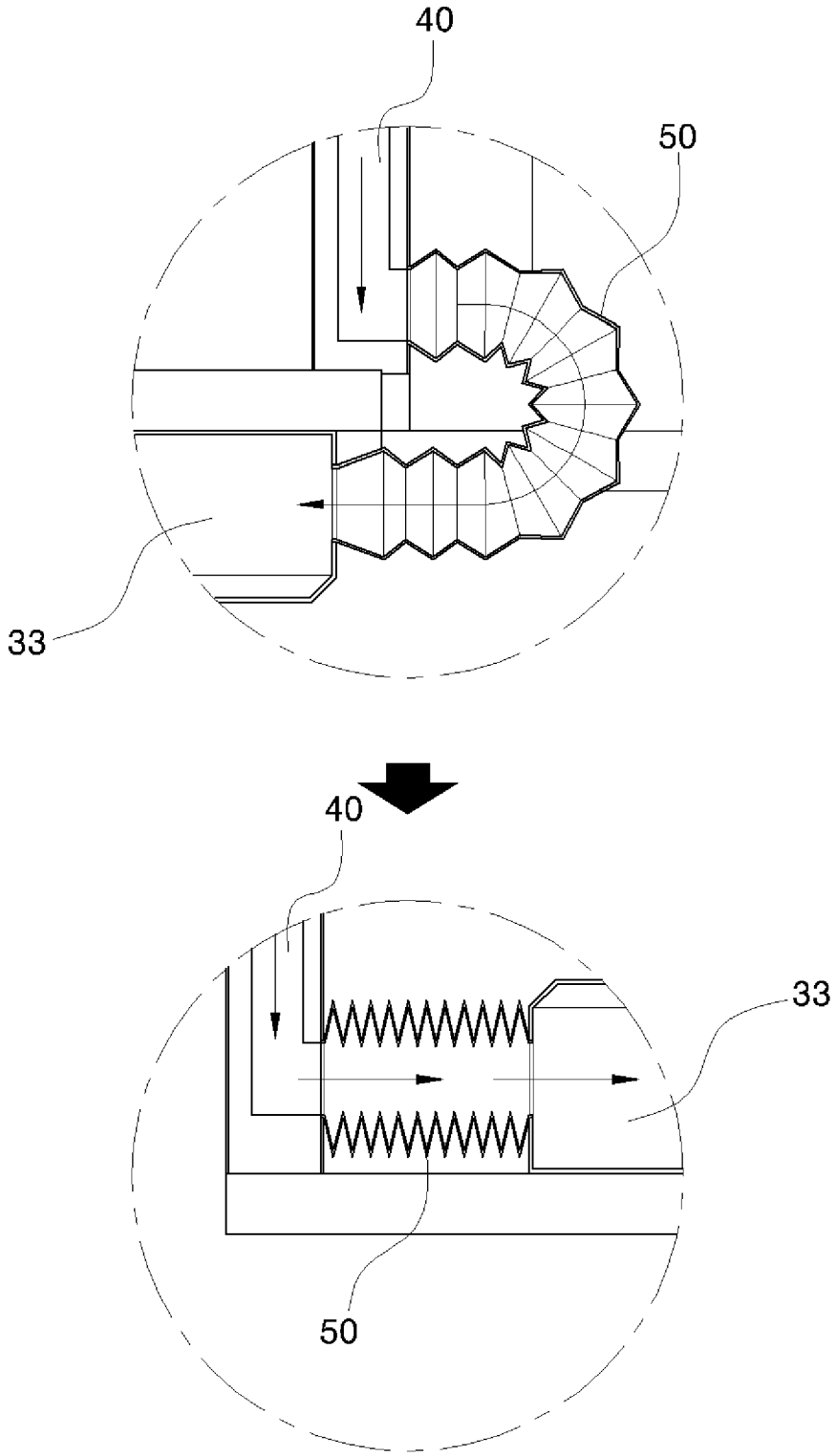
FIGS. 5A to 5C are a sectional view and an enlarged view showing the refrigerator according to the second embodiment of the present invention.
Figure 5B:
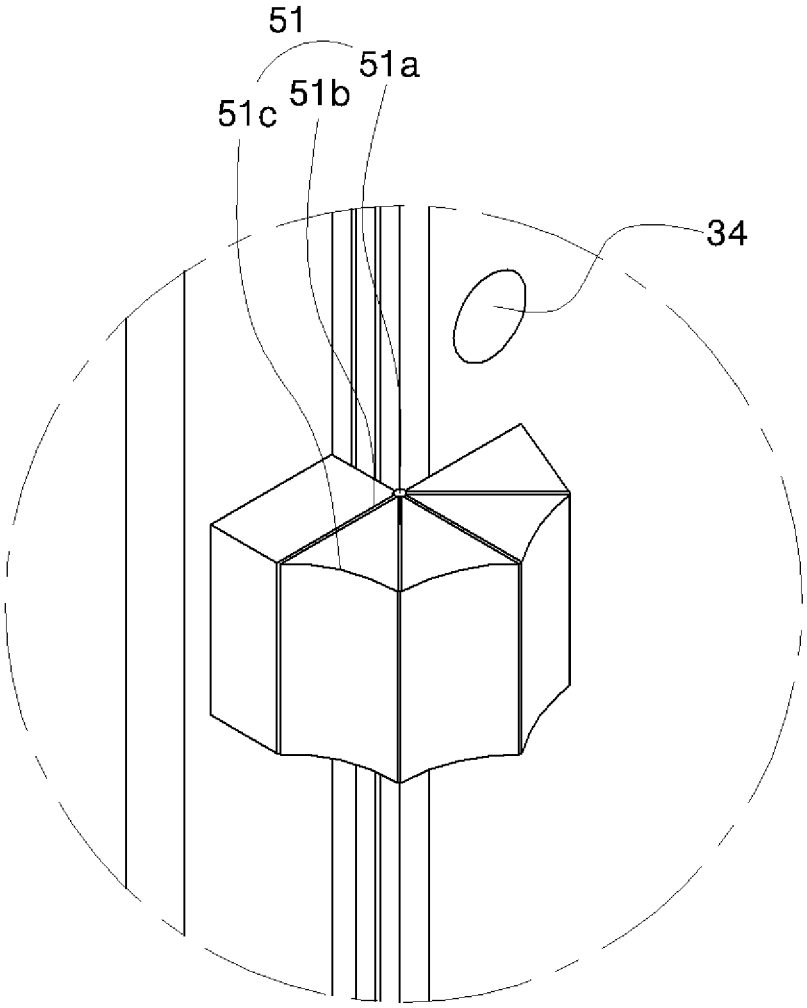

In this case, as shown in FIG. 5B, the flexible connection pipe 51 may be folded by installing a plurality of frames 51*b* rotatably about a hinge shaft 51*a* and installing a cover member 51*c* formed of a soft material at an outer portion of the frame.

Figure 5C:
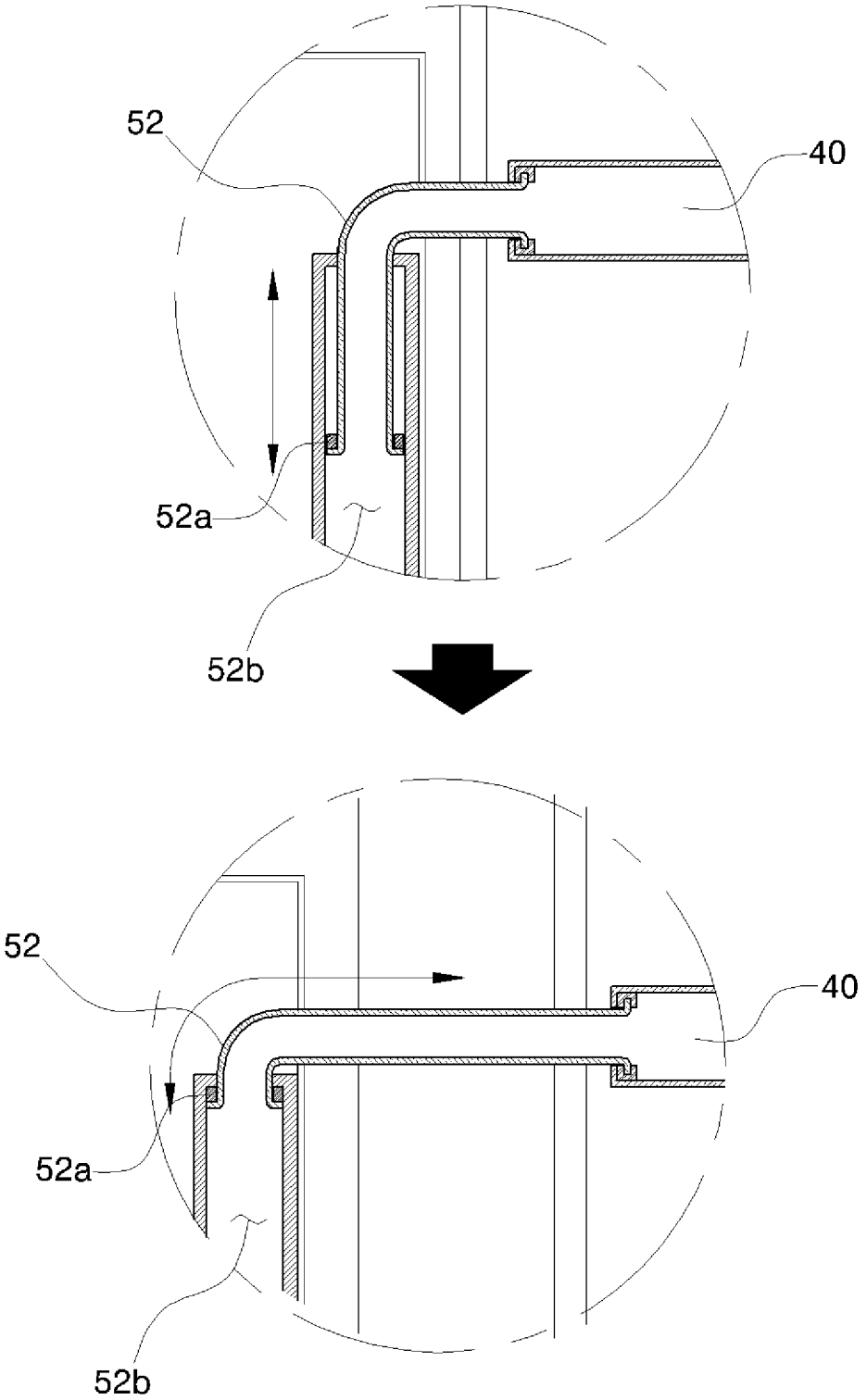

Alternatively, as shown in FIG. 5C, a connection pipe may be configured to have one side fixedly installed inside a through hole, and an opposite side vertically movable inside the ice making compartment.

In other words, a weight part 52*a* is formed at an opposite side of the connection pipe 52 so that the opposite side of the connection pipe is moved down by the weight part when the door is closed.

When the door is open, the opposite side of the connection pipe is pulled and moved up along an inner space 52*b* so that the distance between the door and the refrigerating compartment can be adjusted.

Therefore, according to the present invention, the lengths of the connection pipes 50, 51, and 52 are changed depending on the open/close state of the door 30, so that the cold air is always introduced into the ice making compartment or withdrawn out of the ice making compartment. Accordingly, the ice having the uniform quality can be obtained. In this case, the ice making compartment is maintained in a sealing state so that the foreign matters are not introduced into the ice making compartment by the connection pipe and the ice making compartment is not contaminated, so that the ice having superior quality can be obtained.

Figure 6:
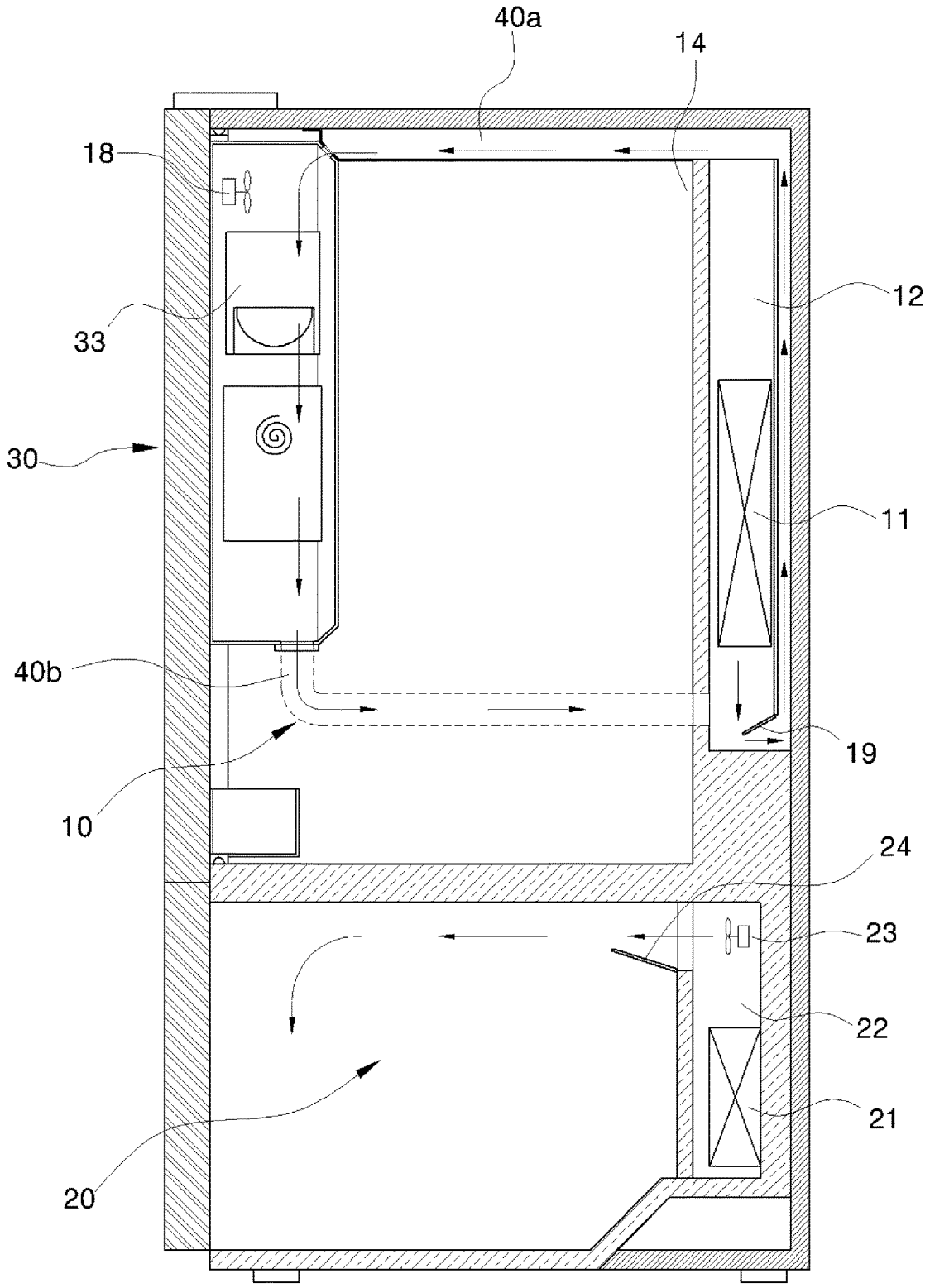
FIG. 6 is a sectional view showing the refrigerator according to the embodiment of the present invention.
Figure 7:
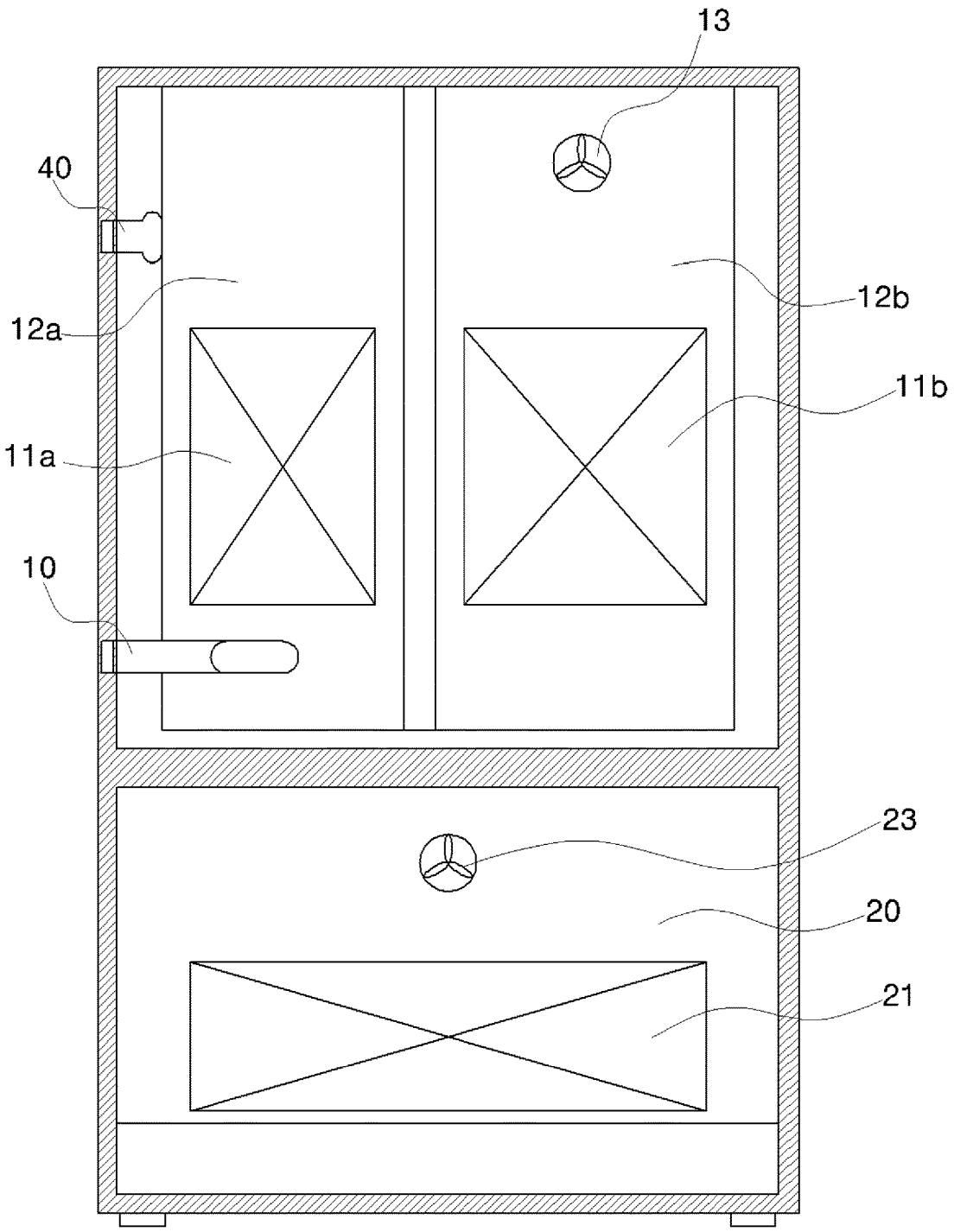
FIG. 7 is a sectional view showing the refrigerator according to the embodiment of the present invention.

FIGS. 6 and 7 are sectional views showing the circulation of the cold air of the refrigerator according to the embodiment of the present invention.

Referring to FIGS. 6 and 7, according to the present invention, the refrigerator is formed at an upper portion thereof with a refrigerating compartment 10.

The refrigerating compartment 10 is formed therein with a first cold air forming part 12*a* and a second cold air forming part 12*b* which are divided into each other.

First and second evaporators 11*a* and 11*b* are installed in the first and second cold air forming parts 12*a* and 12*b*.

In this case, a plurality of fluid passages are formed in the first cold air forming part 12*a* to supply the cold air to the inner part of the refrigerating compartment 10.

A first fan 13 is installed in the first cold air forming part 12*a* to control an amount of cold air introduced into and withdrawn out of the fluid passage or the cooling speed of the cold air.

According to the embodiment, a first damper 14 may be installed in the first cold air forming part 12*a* to control an On/Off state of the cold air.

In addition, the second cold air forming part 12*b* is connected with the cold air inlet/outlet duct 40, and a second damper 19 is installed in the second cold air forming part 12*b* to control the on/off state of the cold air introduced into/withdrawn out of the cold air inlet/outlet duct 40.

In addition, a second fan 18 is installed in the ice making compartment 13 to circulate the cold air.

The second fan 18 not only easily adjusts the cooling speed by circulating the cold air of the ice making compartment 33, but circulates the cold air introduced into or withdrawn out of the second cold air forming part 12*b*.

Therefore, according to the present invention, the cold air formed in the inner part of the first cold air forming part 12*a* is introduced into the refrigerating compartment 10, and the cold air formed in the inner part of the second cold forming part 12*b* is introduced into/withdrawn out of the ice making compartment 33 installed in the door through the cold air inlet/out duct, so that the cold air is independently circulated.

The problem of increasing the power consumption and the noise, the problem caused by the smell movement of the foods, and the problem of forcibly opening the door can be solved.

In addition, the inner part of the refrigerating compartment 10 is maintained in a high-moisture state to freshly store foods, and the freezing compartment 20 is maintained in a dry state to prevent frost from being formed.

In addition, the freezing compartment 20 is formed under the refrigerating compartment 10, a third cold air forming part is separately formed in the freezing compartment 20, and a third evaporator 21 is installed in the third cold air forming part 22.

The third cold air forming part 22 includes a plurality of fluid passages to supply the cold air toward the inside of the freezing compartment 20, and a third fan 23 to control an amount and the cooling speed of cold air and a third damper 24 to control an On/Off state for the introduction/withdrawal of the cold air.

Figure 8:
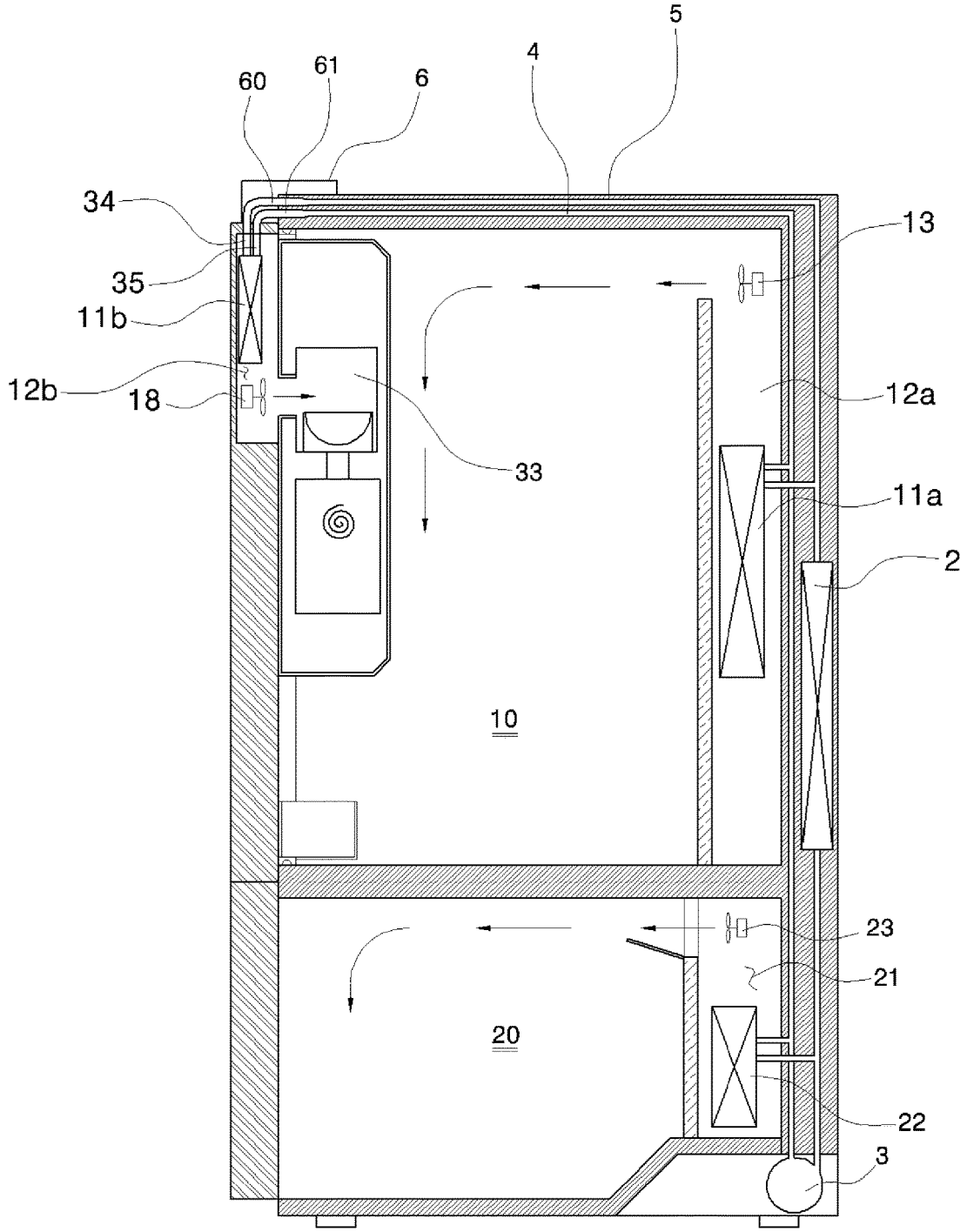
FIG. 8 is a sectional view showing the refrigerator according to the third embodiment of the present invention.
Figure 9:
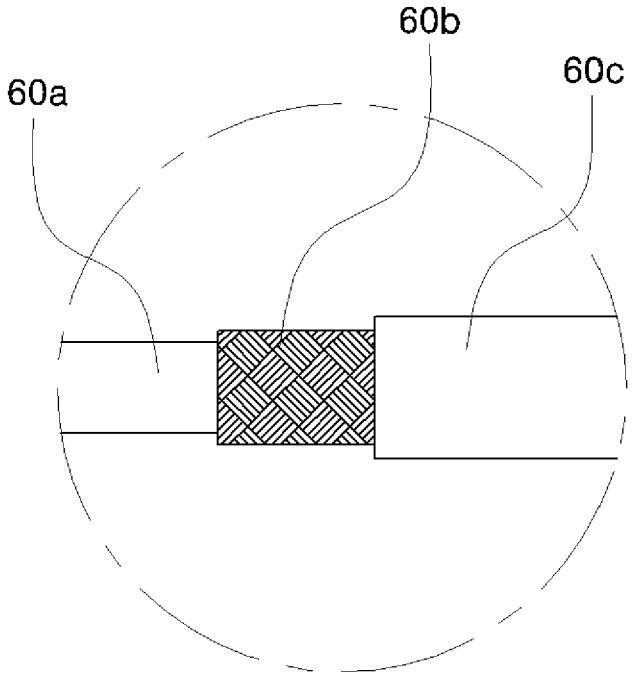
FIGS. 9 and 10 are a sectional view and a side view showing a tube of the refrigerator according to the third embodiment of the present invention.
Figure 10:
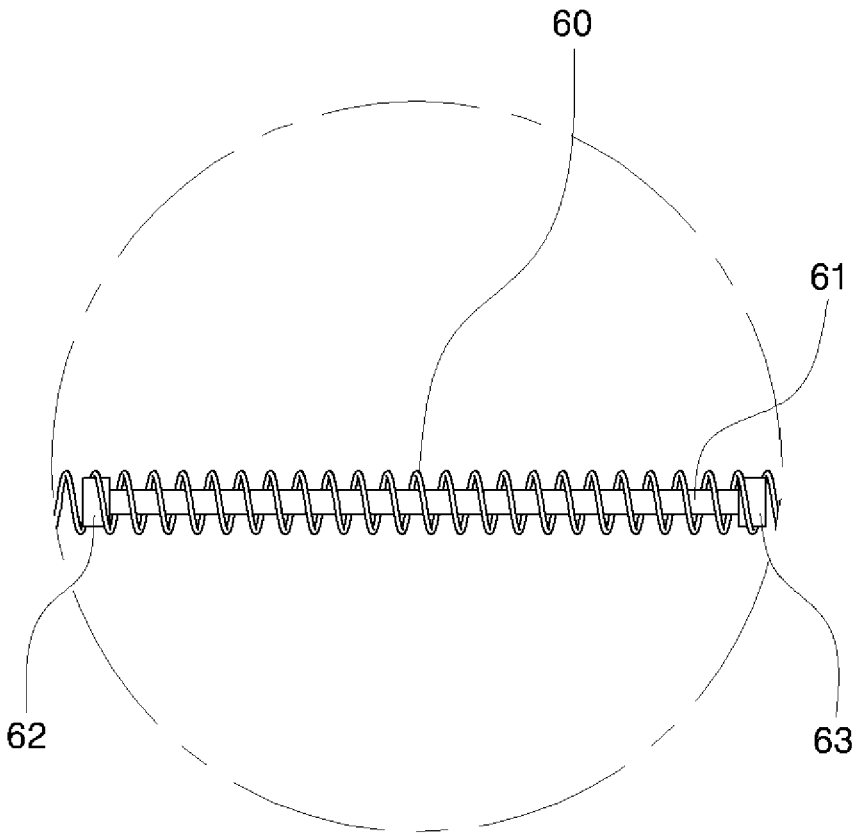

FIGS. 8 to 10 are views showing a refrigerator according to the third embodiment of the present invention.

Referring to FIGS. 8 to 10, according to the present invention, at least one internal space is formed inside a body 1 having a polygonal shape, and a refrigerating compartment 10 and a freezing compartment 20 are formed in the internal space.

In this case, a plurality of shelves are installed in the refrigerating compartment 10 to divided the space of the refrigerating compartment 10 into multiple spaces so that various kinds of foods are efficiently received.

The heights of the shelves can be adjusted and the shelves are detachably attached.

A first evaporator 11*a* is installed at a rear portion of the body.

The first cold air forming part 12*a* is formed inside the body. Accordingly, if the cold air is formed in the inner part of the first cold air forming part 12*a* when the first evaporator 11*a* is operated, the cold air may be circulated toward the inner part of the refrigerating compartment 10 by the first fan 13 and the first damper 14 installed inside the body.

In this case, one side of the first evaporator 11*a* is connected with a condenser 2 formed in the body, and an opposite side of the first evaporator 11*a* is connected with a compressor 3.

For reference, a cold air forming part 22 is formed in the freezing compartment 20.

A third evaporator 21 is installed in the third cold air forming part 22.

One side of the third evaporator 21 is connected with the condenser 2 formed in the body, and an opposite side of the third evaporator 21 is connected with the compressor 3.

In this case, although the third evaporator 21 may be series-connected with the first evaporator 11*a*, the first evaporator 11*a* and the third evaporator 21 may be connected with each other in parallel to each other so that the refrigerating compartment 10 and the freezing compartment 20 are individually controlled.

In addition, the condenser 2 of the body has a pipe to supply a coolant to the door in addition to a pipe to connect the first evaporator 11*a* with the third evaporator 21.

The pipe has an internal space formed inside a furrow connection pipe or inside a hinge 6 of the door to communication with the ice making compartment of the door.

In addition, pipes 4 and 5 are formed in the compressor 3 to receive the coolant from the door in addition to a pipe to connect the first evaporator with the third evaporator.

The pipes 4 and 5 are connected with the ice making compartment of the door in the state that the pipes 4 and 5 are introduced inside the hinge 6 of the door.

In addition, the body is provided at the front surface thereof with at least one door rotatably in an up-down direction or a left-right direction to open the refrigerating compartment or the freezing compartment.

One of the doors has an ice making compartment 33 to receive the cold air formed through the second evaporator 11*b* installed inside an insulating case when the insulating case is assembled, and a storage part to store separated ices.

In this case, the second evaporator 11*b* includes a first connection pipe 34, into which the coolant is introduced, and a second connection pipe 35, from which the coolant is withdrawn, and the first connection pipe 34 and the second connection pipe 35 are embedded in the door.

In this case, a capillary tube 60, which is flexible, is interposed between the door 30 and the body 1 to have one side connected with the first connection pipe 34 of the second evaporator and an opposite side connected with a pipe of the second condenser.

A suction tube 61 is interposed between the door and the body to have one side connected with the second connection pipe 35 of the second evaporator 11*b* and an opposite side connected with a pipe of the compressor.

For reference, the flexible capillary tube 60 is a capillary tube having coupling members formed at one side and an opposite side, one side of the flexible capillary tube 60 is connected with the first connection pipe, and an opposite side of the flexible capillary tube 60 is connected with a pipe of the condenser.

The flexible capillary tube 60 is provided at the center thereof with a flexible core 60*a* interposed between one and opposite coupling members 62 and 63, having a cylindrical shape, and allowing a hot fluid to flow. A polyester braid 60*b* is formed at an outer portion of the flexible core 60*a* and a cover layer 60*c* is formed at an outer portion of the polyester braid, so that the flexible capillary tube 60 is bendable with elasticity.

In addition, the suction tube has coupling members at one side and an opposite side thereof, one side of the suction tube is connected with the second connection pipe, and an opposite side of the suction tube is connected with a pipe of the condenser. The suction tube includes a tube member including a soft material interposed between one and opposite coupling members so that a cold fluid moves through the suction tube.

According to the embodiment, a textured polyester braid may be formed at an outer portion of the tube member including a soft material, and a cover layer is formed at an outer portion of the polyester braid.

The flexible capillary tube 60 and the suction tube 61 are provided inside the connection pipes 50, 51, and 52, or the hinge 6 adjacent to each other.

As heat exchange is performed between the flexible capillary tube and the suction tube, the low-temperature and high-pressure coolant is introduced into the second evaporator.

In this case, in the state that the flexible capillary tube 60 is provided in the form of a spring and wound around the suction valve, the flexible capillary tube 60 may be installed inside the hinge or the connection pipe.

Therefore, according to the present invention, the ice making compartment 33, the freezing compartment 20, and the refrigerating compartment 10 are independently operated, so that the cold air may be continuously supplied to the inner part of the ice making compartment regardless of the open state and the close state of the door. Accordingly, the ices having the uniform quality can be ensured. In addition, the cold air is directly supplied toward the inside of the ice making compartment to minimize the damage caused by the heat loss and noise. In addition, since the ice making compartment is maintained in the sealing state to prevent foreign matters from being introduced into the ice making compartment, the ice making compartment can be always maintained in the clean state.

Figure 11:
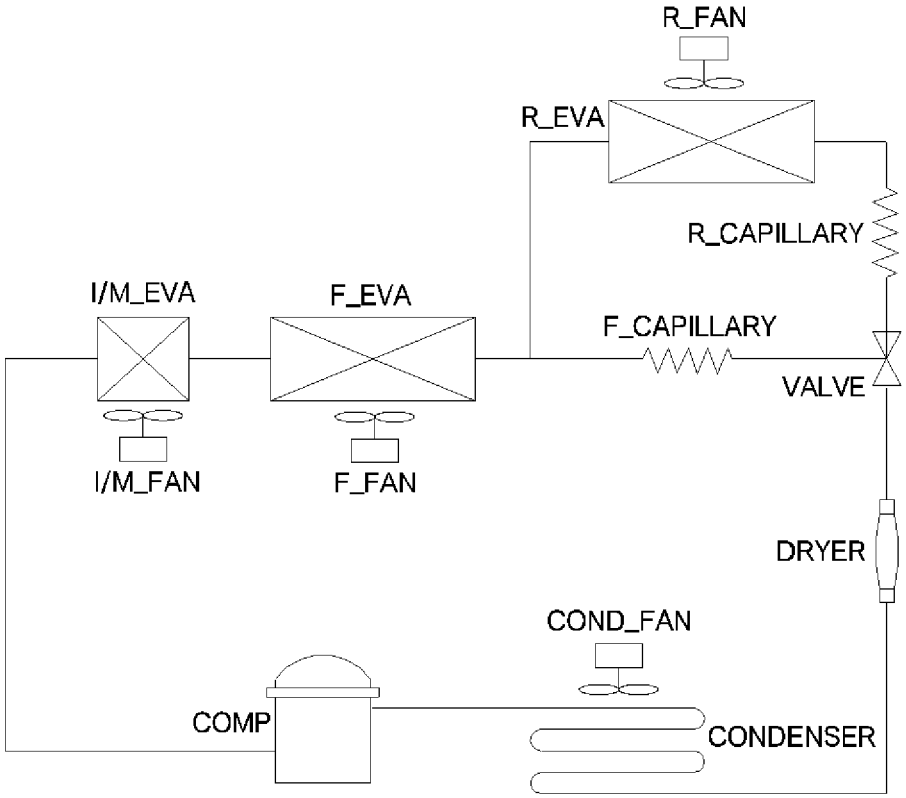
FIGS. 11 to 11B are block diagrams according to the embodiment of the present invention.
Figure 11B:
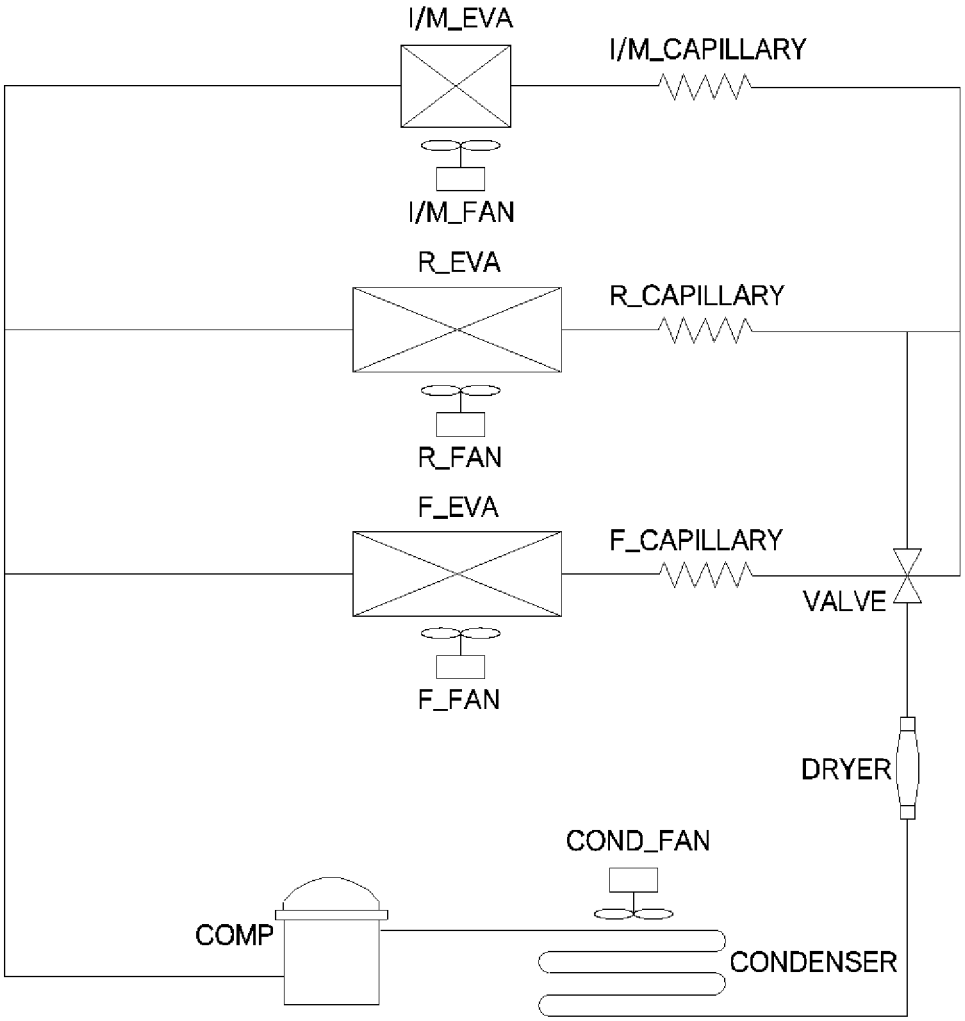

FIGS. 11 to 11B are view briefly showing the structure of the refrigerator according to the embodiment of the present invention.

Referring to FIGS. 11 to 11B, according to the present invention, one side of a compressor is connected with the evaporator of the ice making compartment, and an opposite side of the compressor is connected with a condenser. In addition, the opposite side of the condenser is directly connected with a dryer.

In addition, the opposite side of the drier is connected with an expansion valve VAL_VE, the expansion valve VAL_VE is connected with a capillary tube of the refrigerating compartment 10, and the capillary tube of the refrigerating compartment 10 is connected with the first evaporator R_EVA.

In this case, the opposite side of the first evaporator R_EVA of the refrigerating compartment is connected with the third evaporator F_EVA of the freezing compartment, and the third evaporator F_EVA of the freezing compartment is connected with the second evaporator I/M_EVA, which is installed in the door or the refrigerating compartment, in series. The opposite side of the second evaporator I/M_EVA of the door or the refrigerating compartment is connected with the compressor.

In addition, according to the embodiment of the present invention, the capillary tube R_CAPILLARY of the refrigerating compartment and the first evaporator R_EVA may be connected with each other, the capillary tube F_CAPILLARY of the freezing compartment and the third evaporator F_EVA may be connected with each other in parallel, and the compressor and the condenser may be connected with each other between the valve VAL_VE and the second evaporator I/M_EVA of the door or the refrigerating compartment.

In addition, according to the embodiment of the present invention, the capillary tube F_CAPILLARY of the freezing compartment and the third evaporator F_EVA, which are connected with each other in series, are connected with the valve and the compressor in parallel.

In this state, the capillary tube R_CAPILLARY of the refrigerating compartment and the first evaporator R_EVA, which are series-connected with each other, are connected with the valve and the compressor in parallel.

In addition, the capillary tube I/M_CAPILLARY of the door or the refrigerating compartment and the second evaporator I/M_EVA, which are connected with each other in series, are connected with the valve and the compressor in parallel.

Accordingly, the evaporators are individually operated, so that the cold air formed through the second evaporator I/M_EVA of the refrigerating compartment or the door is applied to the inside of the refrigerating compartment.

Therefore, according to the present invention, the third evaporator is installed in the freezing compartment, the evaporator, or the first and second evaporators are installed in the refrigerating compartment, so that the cold air formed in each independent space is supplied to the ice making compartment, the freezing compartment, and the refrigerating compartment, respectively.

Accordingly, the length of the fluid passage of the cold air is reduced, so that the power consumption and the noise can be reduced.

Further, the refrigerating compartment is maintained in the high moisture state, so that fresh foods can be stored in the cooling state.

In addition, the problems caused by the smell movement of the foods are solved, so that the foods and the ice received in the refrigerating compartment, the freezing compartment, and the ice making compartment can be stored in a clean state.

In addition, when one door of the refrigerating compartment is closed, another door of the freezing compartment can be prevented from being forcibly open.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A refrigerator comprising:

a body formed at a lower portion thereof with a freezing compartment and formed at an upper portion thereof with a refrigerating compartment;

first and second cold air forming parts formed in the refrigerating compartment;

first and second evaporators installed in the first and second cold air forming parts, respectively;

a plurality of doors rotatably installed in the refrigerating compartment and the freezing compartment, respectively;

an ice making compartment formed in the door installed in the refrigerating compartment;

a cold air inlet/outlet duct having one side connected with the second cold air forming part and an opposite end portion exposed inside an inner wall of the refrigerating compartment; and a connection pipe which is installed between the ice making compartment and the cold air inlet/outlet duct and is configured to expand or contract according to open/close states of the door, wherein the cold air inlet/outlet duct and the connection pipe are together configured to guide cold air formed by the second cold air forming part of the refrigerating compartment to the ice making compartment of the door regardless of the open/close states of the door such that uniform quality ice is produced regardless of the open/close states of the door.

2. The refrigerator of claim 1, wherein the refrigerating compartment includes a special compartment separately partitioned, and the special compartment has the second cold air forming part and the second evaporator installed therein.

3. The refrigerator of claim 1, wherein the connection pipe is formed by installing a plurality of frames rotatably about a hinge shaft and installing a cover member including a material at an outer portion of the frames, and folded according to the open/close states of the door.

4. The refrigerator of claim 1, wherein one side of the connection pipe is fixedly installed at a through hole of the cold air inlet/outlet duct, an opposite side of the connection pipe has a weight part, and the connection pipe is installed in an internal space of the ice making compartment such that the opposite side of the connection pipe having the weight part is moved up and down along the internal space of the ice making compartment.

5. The refrigerator of claim 1, wherein one side of the connection pipe is fixedly installed in a through hole of the refrigerating compartment, an opposite side of the connection pipe is installed movably up and down in an internal space of a case including the ice making compartment, a weight part is formed at the opposite side of the connection pipe, the opposite side of the connection pipe is moved down by the weight part when the door is closed, and pulled and moved up when the door is open.

6. The refrigerator of claim 1, further comprising a compressor, a condenser, a dryer, and a valve connected with each other in series in the body, a first capillary tube (F_CAPILLARY) of the freezing compartment and a third evaporator (F_EVA) connected with each other in series between the valve and the compressor, a second capillary tube (R_CAPILLARY) of the refrigerating compartment and the first evaporator (R_EVA), which are connected with each other in series, wherein the second capillary tube (R_CAPILLARY) of the refrigerating compartment and the first evaporator (R_EVA) are connected with the first capillary tube (F_CAPILLARY) of the freezing compartment and the third evaporator (F_EVA) in parallel between the valve and the compressor, and a third capillary tube (I/M CAPILLARY) of the refrigerating compartment and the second evaporator (I/M_EVA), which are connected with each other in series, wherein the third capillary tube (I/M CAPILLARY) of the refrigerating compartment and the second evaporator (I/M_EVA) are connected with the second capillary tube (R_CAPILLARY) of the refrigerating compartment and the first evaporator (R_EVA) in parallel between the valve and the compressor, such that the first to third evaporators are configured to be individually operated to supply the cold air to the ice making compartment, the refrigerating compartment, or the freezing compartment.

* * * * *